US005150671A

United States Patent [19]

Suga

[11] Patent Number: 5,150,671

[45] Date of Patent: Sep. 29, 1992

[54] INTAKE- AND/OR EXHAUST-VALVE TIMING CONTROL SYSTEM FOR INTERNAL COMBUSTION ENGINES

[75] Inventor: Seiji Suga, Kanagawa, Japan

[73] Assignee: Atsugi Unisia Corporation, Kanagawa, Japan

[21] Appl. No.: 784,765

[22] Filed: Oct. 30, 1991

[30] Foreign Application Priority Data

Oct. 31, 1990 [JP] Japan ..... 2-294942

[51] Int. Cl.[5] ..... F01L 1/34

[52] U.S. Cl. ..... 123/90.17; 123/90.31; 464/2

[58] Field of Search ..... 123/90.15, 90.17, 90.31; 464/2

[56] References Cited

U.S. PATENT DOCUMENTS

| | | | |
|---|---|---|---|
| 4,787,345 | 11/1988 | Thoma | 123/90.17 |
| 4,895,113 | 1/1990 | Speier et al. | 123/90.17 |
| 4,903,650 | 2/1990 | Ohlendorf et al. | 123/90.17 |
| 5,012,774 | 5/1991 | Strauber et al. | 123/90.17 |
| 5,058,539 | 10/1991 | Saito et al. | 123/90.17 |

*Primary Examiner*—E. Rollins Cross
*Assistant Examiner*—Weilun Lo
*Attorney, Agent, or Firm*—Bachman & LaPointe

[57] ABSTRACT

An intake- and/or exhaust-valve timing control system for an internal combustion engine comprises a ring gear disposed between a cam sprocket having a driven connection with an engine crankshaft and a camshaft for adjusting the phase angle between the cam sprocket and the camshaft. A drive mechanism is also provided for drivingly controlling the ring gear via fluid pressure depending upon the operating state of the engine. The drive mechanism includes a first hydraulic circuit for creating one axial movement of the ring gear in one axial direction of the camshaft and a second hydraulic circuit for creating the other axial movement of the ring gear in the opposing axial direction of the camshaft, a two-position spool valve coaxially disposed in the front end of the camshaft for selectively switching from one of the first and second hydraulic circuits to the other. The fluid pressure control valve is also provided for generating a control fluid pressure depending upon the operating state of the engine to remotely control the spool valve via the control fluid pressure.

8 Claims, 3 Drawing Sheets

INTAKE- AND/OR EXHAUST-VALVE TIMING CONTROL SYSTEM FOR INTERNAL COMBUSTION ENGINES

BACKGROUND OF THE INVENTION

1. Field of the Invention

The present invention relates to an intake- and/or exhaust-valve timing control system which is optimally adapted for use in internal combustion engines, and specifically to a system which is variably capable of controlling the intake- and/or exhaust-valve timing depending upon the operating state of the engine, for example the magnitude of engine load and/or engine speed.

2. Description of the Prior Disclosure

Recently, there have been proposed and developed various intake- and/or exhaust-valve timing control systems for internal combustion engines for generating optimal engine performance depending on the operating state of the engine.

As is generally known, the valve timing is determined such that optimal engine performance is obtained, however the predetermined valve timing is not suitable under all operating conditions. For instance, when the engine is operating within a range of low engine rotational speeds, higher torque will be obtained with an intake-valve timing earlier than the predetermined valve timing.

Such a conventional intake- and/or exhaust-valve timing control system for internal combustion engines has been disclosed in Japanese Patent First Publication No. 1-300006 corresponding to German Patent Application No. P3810804.6. In this conventional valve timing control system, a cam sprocket having a driven connection with an engine crankshaft is rotatably supported through a ring gear mechanism at the front end of a camshaft. The ring gear mechanism includes a ring gear having an inner toothed portion engaging another toothed portion formed on the front end of the camshaft and an outer toothed portion engaging an inner toothed portion formed on the inner peripheral wall of the cam sprocket. In this manner, the ring gear rotatably engages between the cam sprocket and the camshaft. At least one of the two meshing pairs of gears is helical. The result is that axial sliding movement of the ring gear relative to the camshaft causes the camshaft to rotate about the cam sprocket and therefore the phase angle between the camshaft and the cam sprocket (and consequently, the phase angle between the camshaft and the crankshaft) is varied relatively. The ring gear is axially moved by the pressure difference between working fluid pressures applied to two pressure chambers, respectively defined at both ends of the ring gear in conjunction with the inner peripheral wall of the cam sprocket and the outer peripheral wall of the front end of the camshaft. A two-position spool valve is provided to supply fluid pressure from an oil pan through an engine oil pump to one pressure chamber defined in one side of the ring gear and in addition to exhaust fluid pressure from the other pressure chamber defined in another side of the ring gear to the engine oil pan. The former hydraulic circuit corresponds to an oil-supply hydraulic circuit, whereas the latter hydraulic circuit corresponds to an oil-exhaust hydraulic circuit. Both oil-supply and oil-exhaust hydraulic circuits are connected via the previously noted one spool valve to the pressure chambers. A spool slidably enclosed in the two-position spool valve is switchable by means of an electromagnetic actuator assembly attached to a rocker cover. The spool valve assembly and the electromagnetic actuator assembly are coaxially arranged with respect to each other. The plunger piston is directly connected to the spool so as to operate the spool valve between two positions.

In the aforementioned constructions, the conventional valve timing control system can provide a superior step-response and a relatively wide adjustable amount of the valve timing. However, since the electromagnetic actuator is disposed essentially in the vicinity of the front end of the camshaft, the entire length of the valve timing system is increased and as a result the overall engine size and engine weight become large. Therefore, the lay-out of the engine may be limited in the engine room.

SUMMARY OF THE INVENTION

It is, therefore in view of the above disadvantages, an object of the present invention to provide a small sized intake- and/or exhaust-valve timing control system for internal combustion engines.

It is another object of the invention to provide an intake- and/or exhaust-valve timing control system for internal combustion engines, with a relatively simple construction of a phase-angle adjustment subassembly of the valve timing control system which subassembly is attached to the front end of the camshaft in such a manner as to adjust the phase angle between the camshaft and the cam sprocket.

According to one aspect of the invention, an intake- and/or exhaust-valve timing control system for an internal combustion engine includes a ring gear member disposed between a rotating member having a driven connection with an engine crankshaft and a camshaft for adjusting the phase angle between the rotating member and the camshaft, a drive mechanism provided for drivingly controlling the ring gear member via fluid pressure depending upon the operating state of the engine. The drive mechanism includes a first hydraulic circuit for creating one axial movement of the ring gear member in one axial direction of the camshaft, a second hydraulic circuit for creating the other axial movement of the ring gear member in the opposing axial direction of the camshaft. Switching means is disposed in the camshaft for selectively switching from one of the first and second hydraulic circuits to the other and in addition fluid pressure control means is provided for generating a control fluid pressure depending upon the operating state of the engine to control the switching means via the control fluid pressure.

According to another aspect of the invention, an intake- and/or exhaust-valve timing control system for an internal combustion engine includes a ring gear member disposed between a rotating member having a driven connection with an engine crankshaft and a camshaft for adjusting the phase angle between the rotating member and the camshaft, a drive mechanism provided for drivingly controlling the ring gear member via fluid pressure depending upon the operating state of the engine. The drive mechanism includes a first hydraulic circuit for supplying working fluid from an oil pressure source pressurizing the working fluid to a first pressure chamber defined at one end of the ring gear member in conjunction with the rotating member and the camshaft and for exhausting the working fluid from a second pressure chamber defined at the other end of the ring gear member in conjunction with the rotating member and the camshaft to an oil pan of the engine, a second hydraulic circuit for supplying the working fluid from the oil pressure source to the second pressure chamber and for exhausting the working fluid from the first pressure chamber to the oil pan, switching means disposed in the camshaft for selectively switching from one of first and second the hydraulic circuits to the other, and fluid pressure control means for generating a control fluid pressure depending upon the operating state of the engine to remotely control the switching means via the control fluid pressure.

The switching means includes a two-position spool valve coaxially disposed in the front end of the camshaft and connected to the first and second hydraulic circuits. The fluid pressure control means may preferably include an electromagnetic valve mounted on a cylinder head or a cylinder block of the engine. The fluid pressure control means may preferably include a coaxial fluid passage coaxially bored at the front end of the camshaft so as to apply the control fluid pressure in a central axial direction of the two-position spool valve.

DESCRIPTION OF THE PREFERRED EMBODIMENT

Figure 1A:
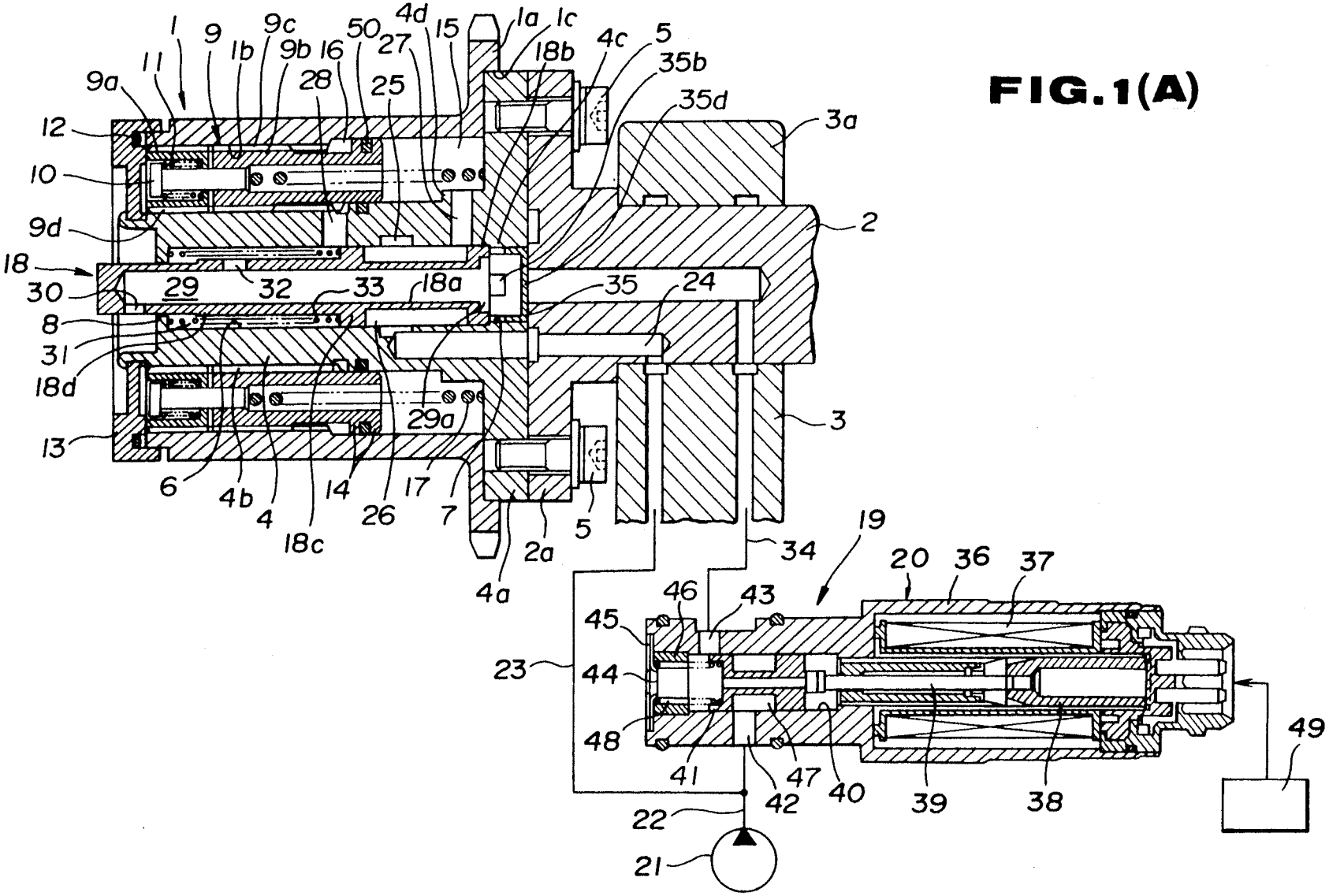
FIG. 1A is a longitudinal cross-sectional view illustrating a preferred embodiment of an intake- and/or exhaust-valve timing control system for internal combustion engines according to the invention, with a spool valve maintained in a rightmost position.
Figure 1B:
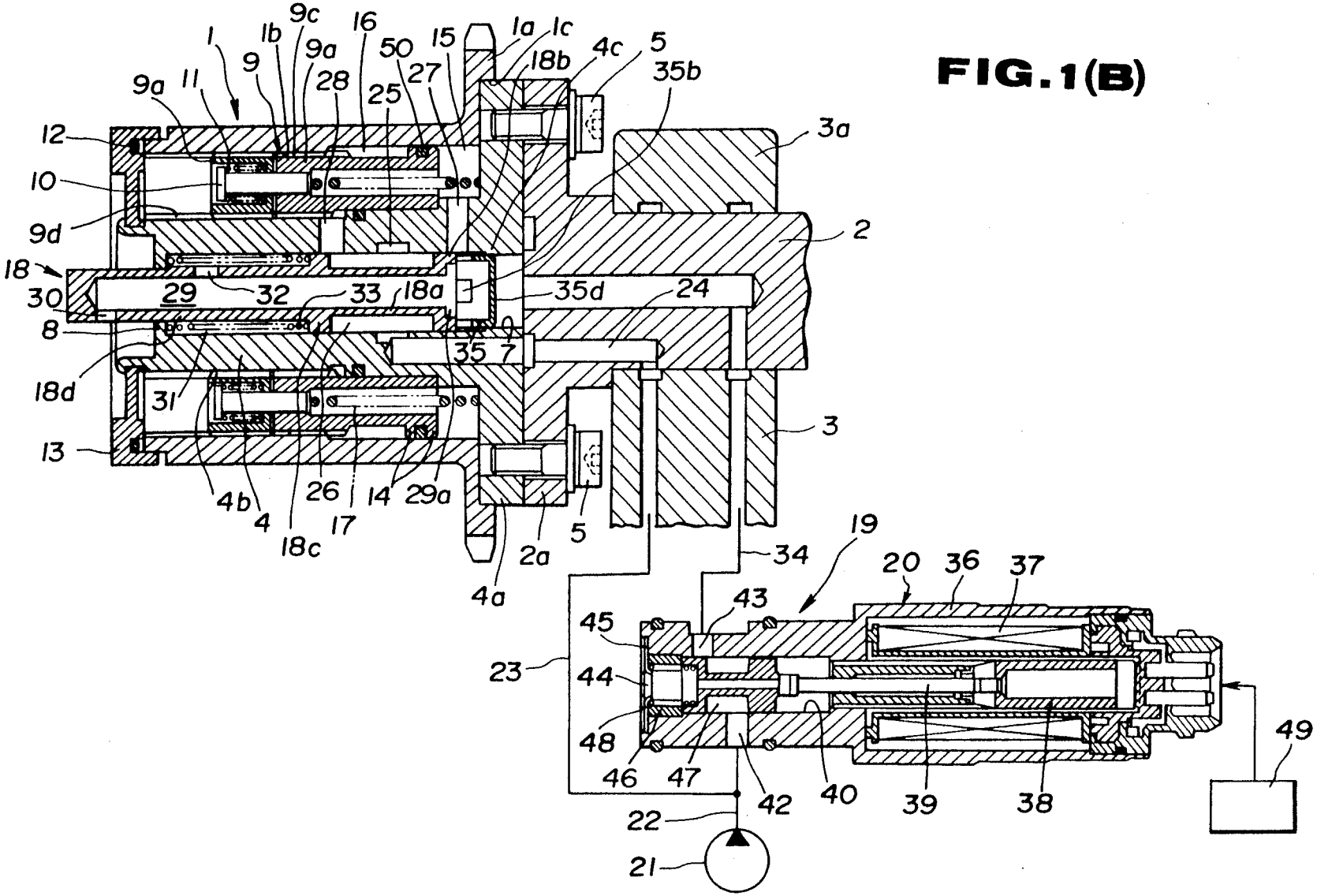
FIG. 1B is a longitudinal cross-sectional view illustrating the embodiment of FIG. 1A, with a two-position spool valve maintained in a leftmost position.

The principles of the present invention applied to intake- and/or exhaust-valve timing control systems for internal combustion engines are illustrated in FIGS. 1A and 1B.

FIGS. 1A and 1B show the front end section of a camshaft 2 provided for opening and closing an intake- and/or exhaust-valve (not shown). The camshaft 2 is journaled by a cylinder head 3 and a bearing member 3*a*. Reference numeral 1 denotes an outer cylindrical member including a cam sprocket 1*a* driven by a timing chain (not shown) for transmitting torque from an engine crankshaft (not shown). As seen in FIGS. 1A and 1B, the cam sprocket 1 and the camshaft 2 are coaxially arranged to each other. The outer cylindrical member 1 includes a relatively long inner toothed portion 1*b* axially extending along the inner peripheral wall thereof. The camshaft 2 includes a substantially annular flange 2*a* integrally formed at the front end of the camshaft 2. The annular flange 2*a* includes an annular, front flat surface. Reference numeral 4 denotes an inner cylindrical sleeve integrally formed with an annular flange 4*a* having an annular, rear flat surface. The sleeve 4 is connected through the flange 4*a* to the flange 2*a* to rotate with the camshaft 2 in such a manner that the rear flat surface of the flange 4*a* abuts the front flat surface of the flange 2*a* and the two flanges are securely connected to each other by means of bolts 5. The sleeve 4 includes an outer toothed portion 4*b* formed on the outer peripheral surface thereof. The sleeve 4 includes an inner bore 6 coaxially extending therein for slidably enclosing a spool of a spool valve 18 (hereinafter described in detail) and a relatively short inner bore 7 coaxially extending from the inner bore 6 for slidably enclosing a push member 35. The sleeve also includes an annular section 8 slidably supporting the rear end section of the spool.

A ring gear mechanism 9 is provided between the outer cylindrical member 1 and the inner cylindrical sleeve 4. The ring gear mechanism 9 includes a ring gear which is comprised of a first ring gear element 9*a* and a second ring gear element 9*b*. The first and second ring gear elements 9*a* and 9*b* are formed in such a manner as to divide a relatively long ring gear including outer and inner toothed portions 9*c* and 9*d* into two parts by cutting or milling. Therefore, the first and second ring gear elements 9*a* and 9*b* have essentially the same geometry with regard to both inner and outer teeth. These ring gear elements 9*a* and 9*b* are interconnected by a plurality of connecting pins 10 which are fixed on the second ring gear element 9*b* through the annular hollow defined in the first ring gear element 9*a*. The annular hollow is traditionally filled with elastic material, such as a cylindrical rubber bushing attached by vulcanizing. Alternatively, as shown in FIG. 1A, a plurality of coil springs 11 may be provided in the annular hollow. The springs 11 are supported by the heads of the connecting pins 10 serving as spring seats. When the first and second ring gear elements 9*a* and 9*b*, and the connecting pins 10 are assembled, the first and second ring gear elements 9*a* and 9*b* are interconnected in such a manner as to be slightly offset from each other. In other words, the angular phase relationship between the ring gear elements 9*a* and 9*b* is designed so as to be set an angular position slightly offsets from an angular position in which the tooth traces between the two ring gear elements 9*a* and 9*b* are exactly aligned with each other. As appreciated from FIG. 1A, when the ring gear, the outer cylindrical member 1 and the sleeve 4 are assembled, the outer and inner toothed portions 9*c* and 9*d* are respectively meshed with the inner toothed portion 1*b* of the outer cylindrical member 1 and the outer toothed portion 4*b* of the sleeve 4. At least one of the two meshing pairs of teeth (9*c*,1*b* ; 9*d*,4*b*) is helical to provide axial sliding movement of the ring gear relative to the camshaft 2.

The front end of the outer cylindrical member 1 is hermetically covered through a seal ring 12, such as an O ring, by a substantially annular end plate 13 in a water-tight fashion. The inner circumferential portion of the end plate 13 is fixed on the front, annular hub of the sleeve 4 by caulking. On the other hand, the rear end of the outer cylindrical member 1 is rotatably fitted through its rear bore 1*c* onto the outer circumferential portion of the flange 4*a* of the sleeve 4 in a water-tight fashion. The axially forward movement of the first ring gear element 9*a* is restricted by the the end plate 13 such that the front end of the first ring gear element 9*a* abuts the inner wall of the end plate 13. The axially rearward movement of the second ring gear element 9*b* is restricted by the shoulder 4*d* of the sleeve 4. The second ring gear element 9*b* includes two annular ridges 14 closely juxtaposed to each other at the rear end thereof. A seal ring 50 is fitted into an annular groove defined between the two annular ridges 14. In these constructions, first and second pressure chambers 15 and 16 are defined at both ends of the seal ring 50. A compression spring 17 is disposed in the first pressure chamber 15 so as to normally bias the second ring gear element 9*b* leftwards (viewing FIG. 1A).

The spool of the spool valve 18 is comprised of five sections, namely a first section being a first valve section 18*b* slidably enclosed in the inner bore 6 in a water-tight fashion, a second section being a small diameter section 18*a*, a third section being a second valve section 18*c* slidably enclosed n the inner bore 6 in a water-tight fashion, a fourth section being a stepped section 18*d* having a shoulder at its rear end and a fifth section being a rear end section slidably supported by the annular section 8. The spool is normally biased rightwards (viewing FIG. 1A) by means of a return spring 33, such as a compression spring.

As set forth above, a phase-angle adjustment subassembly of the valve timing control system according to the invention is mainly constructed by the outer cylindrical member 1, the sleeve 4, the ring gear mechanism 9 and the spool valve 18. The phase-angle adjustment subassembly also includes a plurality of working fluid passages.

The above mentioned fluid passages will be hereinbelow described in detailed in accordance with the flow of oil supplied from an oil pan through an engine oil pump 21, an oil main gallery 22, an oil supply passage 23, an oil supply passage defined in the cylinder head 3 and the bearing member 3*a*, and a longitudinal oil passage 24 defined in the front end of the camshaft 2 to the spool valve 18.

FIG. 1A shows a first state of the spool valve 18, wherein the spool is positioned in a rightmost position. The axially rightward movement of the spool is restricted by a shoulder 4*c* formed in the inner circumferential portion of the flange 4*a*. In the rightmost position of the spool valve, working fluid is supplied from the oil pump 21 through the main gallery 22, the oil supply passage 23, the longitudinal oil passage 24 and an annular oil groove 25 formed in the inner bore 6 of the sleeve 4 to a cylindrical oil passage 26 defined between the first and second valve sections 18*b* and 18*c*, in that order. Pressurized working fluid is subsequently supplied through a radial oil passage 27 radially bored in the sleeve 4 in the vicinity of the flange 4*a* to the first pressure chamber 15. On the other hand, working fluid in the second chamber 16 is drained from a radial oil passage 28 bored in a substantially center section of the sleeve 4 through an annular drain passage 31 defined between the inner bore 6 and the stepped section 18*d* and the rear end section of the spool valve 18, a radial opening 32 bored in the stepped section 18*d*, a cylindrical hollow 29 defined in the spool, and a radial opening 30 bored in the rear end section of the sleeve 4 to the oil pan (not shown), in that order. In the rightmost position of the spool, the first valve section 18*b* functions to establish the communication between the oil passages 26 and 27, while the second valve section 18*c* functions to block the communication between the oil passages 26 and 28. An opening end 29*a* of the spool is closed by the inner circumferential wall of the flange 4*a* and the push member 35. As seen in FIG. 1A, when the spool is kept in the rightmost position, fluid pressure in the first pressure chamber 15 becomes kept high, whereas fluid pressure in the second pressure chamber 16 becomes kept low and as a result the ring gear is kept in the leftmost position. When the engine is stopped, the ring gear is kept in the leftmost position by means of the spring 17. That is, the leftmost position of the ring gear essentially corresponds to an initial position at which the valve timing is initialized and the valve timing is set to a predetermined reference valve timing required in a low load state of the engine.

Alternatively, FIG. 1B shows a second state of the spool valve 18, wherein the spool is positioned in a leftmost position. In the leftmost position of the spool valve, pressurized working fluid is supplied from the oil pump 21 through the main oil gallery 22, oil supply passage 23, and the longitudinal oil passage 24 to the cylindrical oil passage 26 of the spool valve. Pressurized working fluid in the oil passage 26 is subsequently fed through the oil passage 28 to the second pressure chamber 16. On the other hand, working fluid in the first pressure chamber 15 is drained from the oil passage 27 through a plurality of cut-outs 35*b* of the push member 35, the opening end 29*a*, the cylindrical hollow 29 and the radial opening 30 to the oil pan, in that order. In the leftmost position of the spool, the first valve section 8*b* functions to block the communication between the oil passages 26 and 27, while the second valve section 18*c* functions to establish the communication between the oil passages 26 and 28. As seen in FIG. 1B, when the spool is kept in the leftmost position, fluid pressure in the first pressure chamber 15 becomes kept low, whereas fluid pressure in the second pressure chamber 16 becomes kept high and as a result the ring gear is kept in the rightmost position.

Figure 2:
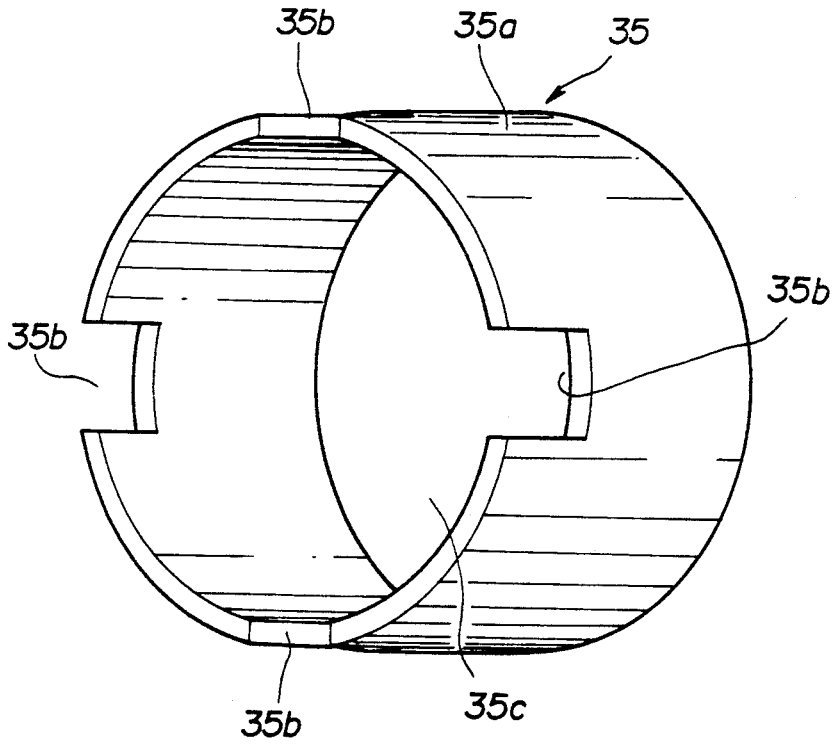
FIG. 2 is a perspective view illustrating a push member coming into contact with the spool slidably enclosed in the spool valve so as to create the axially sliding movement of the spool.

Referring now to FIG. 2, the push member 35 is comprised of a cylindrical section 35*a* and a circular bottom section 35*c*. A plurality of cut-outs 35*b* are formed in the cylindrical section 35*a*. The bottom section 35 includes a flat pressurized surface 35*d* as shown in FIGS. 1A and 1B. The push member 35 is shifted from the rightmost position shown in FIG. 1A to the leftmost position shown in FIG. 1B in response to a control oil pressure generated by a fluid pressure control valve 20. The control oil pressure is fed through a control oil passage 34 connected to the pressure control valve 20 to the pressurized surface 35*d* of the push member 35. In the preferred embodiment, the control oil passage 34 includes a coaxial bore bored along the center axis of the front end of the camshaft 2, so as to effectively apply the control oil pressure to the pressurized surface 35*d* of the push member. The control oil passage 34 includes a control oil supply passage being closely juxtaposed to the oil supply passage of the spool valve 18, bored in the cylinder head 3. The coaxial bore and the control oil supply passage are communicated to each other through a radial oil passage formed in the camshaft 2 and an annular oil passage defined by the inner circumferential groove section of the bearing member 3*a* and the upper groove section of the cylinder head 3 in conjunction with the outer circumferential wall of the camshaft 2. The center arrangement of the coaxial bore included in the control oil passage 34 results in a high step-response with regard to a switching control of the spool valve 18. That is, a working fluid pressure control device 19 for the spool valve 18 comprises the fluid pressure control valve 20, the control oil passage 34 and the push member 35.

As shown in FIG. 1A, the fluid pressure control valve 20 preferably comprises an electromagnetic solenoid valve including a cylindrical valve housing 36, an exciting coil 37, a magnetic core 38, a plunger piston 39 connected to the magnetic core 38 and a spool 41 slidably enclosed in a bore 40 formed in the front end of the valve housing 36. As appreciated from the drawing, the front end of the electromagnetic valve 20 constructs a two-position spool valve. For this reason, the front end of the valve 20 includes a first oil passage 42 connected to the main oil gallery 22, a second oil passage 43 connected to the control oil passage 34 and an oil drain passage 44. The axially leftward sliding movement of the spool 41 is restricted by a ring bushing 46 fixed at the front end of the valve housing 36 by means of a spring retainer 45. The spool 41 is normally biased in the right direction (viewing FIGS. 1A and 1B) by means of a return spring 48, such as a compression spring. The spool 41 is connected to the plunger rod 39. When the exciting coil 37 is activated, the spool 41 is positioned in the leftmost position against spring force created by the spring 48 in accordance with the sliding movement of the electromagnetic core 38 and the plunger rod 39, as seen in FIG. 1B. Conversely, when the exciting coil 37 is deactivated, the spool 41 is positioned in the rightmost position by spring force created by the spring 48, as seen in FIG. 1A. In the rightmost position of the spool 41 shown in FIG. 1A, the spool 41 serves to block the communication between the first and second oil passages 42 and 43 and in addition to establish the communication between the second oil passage 43 and the drain passage 44. On the other hand, in the leftmost position of the spool 41 shown in FIG. 1B, the spool 41 serves to establish the communication between the first and second oil passages 42 and 43 through an annular oil passage 47 defined by an annular hollow of the spool 41 and the bore 40 and in addition to block the communication between the second oil passage 43 and the drain passage 44. The operation of the electromagnetic valve 20 is controlled in response to a control signal generated from a controller 49 processing input information representative of the operating state of the engine, which information is received through a crank-angle sensor (not shown) monitoring an engine crank angle and an air-flow meter (not shown) provided in an air intake passage downstream of an air cleaner (not shown).

In the intake- and/or exhaust-valve timing control system for internal combustion engines according to the invention, note that the spool valve 18 employed in the sleeve 4 is not directly operated by a fluid pressure control actuator, such as an electromagnetic actuator, but remotely operated by a control oil pressure generated from another fluid pressure control valve, such as a two-position electromagnetic valve which can be located in a relatively free position. Preferably, the electromagnetic valve 20 may be provided in the cylinder head 3 or the cylinder block (not shown). Furthermore, in the embodiment, lubricating oil for the internal combustion engine is served as working fluid for both the spool valve 18 and the electromagnetic solenoid valve 20.

The valve timing control system for internal combustion engines according to the invention operates as follows.

When the engine is operated under low load, the control signal from the previously noted controller 49 is in an OFF state, with the result that the electromagnetic valve 20 is deactivated by the controller. Therefore, as shown in FIG. 1A, the plunger rod 39 remains in the innermost position thereof and as a result the spool 41 is retained by the spring 48 in the oil drain position, i.e., the rightmost position wherein the control oil pressure is relieved from the pressurized surface 35*d* of the push member 35 in such a manner to be drained from the control oil passage 34 through the second oil passage 43 and the drain passage 44 to the oil pan. As a result, the spool valve 18 is kept in the rightmost position by the return spring 33. As previously described in detail, the first pressure chamber 15 becomes high whereas the second pressure chamber 16 becomes low, with the result that the ring gear is kept in the leftmost position. Thus, the relative phase angle between the cam sprocket 1*a* and the camshaft 2 is set to a predetermined phase angle in which an intake- and/or exhaust-valve timing relative to the crank angle is initialized. Under this condition, the timing of valve closing is in general delayed in relation to the piston position in the cylinder, thereby resulting in a high charging efficiency of air-fuel mixture introduced through the intake-valve to the combustion chamber, due to the inertia of fluid mass of the introduced mixture.

Conversely, when the operating state of the engine is changed from a low load to a high load, the control signal generated from the controller is output to the exciting coil 37 of the electromagnetic valve 20, with the result that the electromagnetic valve 20 is activated by the controller. Therefore, as shown in FIG. 1B, the plunger rod 39 is moved to the outermost position thereof and as a result the spool 41 is moved from the rightmost position to the leftmost position against spring force generated by the spring 48, with the result that the control oil pressure is applied to the pressurized surface 35*d* of the push member 35 from the oil pump 21 through the the first oil passage 42, the annular oil passage 47, the second oil passage 43 and the control oil passage 34. The spool valve 18 is pushed by the push member 35 and consequently positioned in the leftmost position against spring force created by the spring 33. As a result, the first pressure chamber becomes low, while the second pressure chamber high, with the result that the ring gear is kept in the rightmost position. Thus, the phase angle between the cam sprocket 1*a* and the camshaft 2 is relatively changed to a predetermined phase angle which corresponds to an optimal phase angle during high engine load conditions. In this manner, the timing of valve opening is advanced in relation to the piston position, thereby resulting in a high combustion efficiency, i.e., a high engine torque due to a high charging efficiency of air-fuel mixture.

As will be appreciated from the above, in the preferred embodiment, since working fluid pressure in one of the two pressure chambers 15 and 16 is forcibly increased and working fluid in the other pressure chamber is forcibly decreased by means of the two-position spool valve 18 remotely operated in response to the control oil pressure from the solenoid valve 20, the position of the ring gear may be rapidly changed. This assures a high step-response of an intake- and/or exhaust-valve timing control.

What is claimed is:

1. In an intake- and/or exhaust-valve timing control system for an internal combustion engine including a ring gear member disposed between a rotating member having a driven connection with an engine crankshaft and a camshaft for adjusting the phase angle between said rotating member and said camshaft, a drive mechanism provided for drivingly controlling said ring gear member via fluid pressure depending upon the operating state of said engine; the improvement comprising:

said drive mechanism including;

a first hydraulic circuit for creating one axial movement of said ring gear member in one axial direction of said camshaft;

a second hydraulic circuit for creating the other axial movement of said ring gear member in the opposing axial direction of said camshaft;

switching means disposed in said camshaft for selectively switching from one of said first and second hydraulic circuits to the other; and fluid pressure control means for generating a control fluid pressure depending upon the operating state of said engine to control said switching means via said control fluid pressure.

2. The intake- and/or exhaust-valve timing control system as set forth in claim 1, wherein said switching means including a two-position spool valve coaxially disposed in the front end of said camshaft and connected to said first and second hydraulic circuits.

3. The intake- and/or exhaust-valve timing control system as set forth in claim 2, wherein said fluid pressure control means including an electromagnetic valve mounted on a cylinder head or a cylinder block of said engine.

4. The intake- and/or exhaust-valve timing control system as set forth in claim 3, wherein said fluid pressure control means including a coaxial fluid passage coaxially bored at the front end of said camshaft so as to apply said control fluid pressure in a central axial direction of said two-position spool valve.

5. In an intake- and,/or exhaust-valve timing control system for an internal combustion engine including a ring gear member disposed between a rotating member having a driven connection with an engine crankshaft and a camshaft for adjusting the phase angle between said rotating member and said camshaft, a drive mechanism provided for drivingly controlling said ring gear member via fluid pressure depending upon the operating state of said engine; the improvement comprising:

said drive mechanism including;

a first hydraulic circuit for supplying working fluid from an oil pressure source pressurizing the working fluid to a first pressure chamber defined at one end of said ring gear member in conjunction with said rotating member and said camshaft and for exhausting the working fluid from a second pressure chamber defined at the other end of said ring gear member in conjunction with said rotating member and said camshaft to an oil pan of said engine;

a second hydraulic circuit for supplying the working fluid from said oil pressure source to said second pressure chamber and for exhausting the working fluid from said first pressure chamber to said oil pan;

switching means disposed in said camshaft for selectively switching from one of first and second said hydraulic circuits to the other; and fluid pressure control means for generating a control fluid pressure depending upon the operating state of said engine to remotely control said switching means via said control fluid pressure.

6. The intake- and/or exhaust-valve timing control system as set forth in claim 5, wherein said switching means including a two-position spool valve coaxially disposed in the front end of said camshaft and connected to said first and second hydraulic circuits.

7. The intake- and/or exhaust-valve timing control system as set forth in claim 6, wherein said fluid pressure control means including an electromagnetic valve mounted on a cylinder head or a cylinder block of said engine.

8. The intake- and/or exhaust-valve timing control system as set forth in claim 7, wherein said fluid pressure control means including a coaxial fluid passage coaxially bored at the front end of said camshaft so as to apply said control fluid pressure in a central axial direction of said two-position spool valve.

* * * * *